United States Patent [19]

Lewis et al.

[11] 4,074,797

[45] Feb. 21, 1978

[54] SINGLE STATION, PLURAL FUNCTION PRINTER

[75] Inventors: Kim R. Lewis, Lansing; William H. Corbett, Ithaca, both of N.Y.

[73] Assignee: NCR Corporation, Dayton, Ohio

[21] Appl. No.: 766,292

[22] Filed: Feb. 7, 1977

Related U.S. Application Data

[63] Continuation of Ser. No. 638,796, Dec. 8, 1975, abandoned.

[51] Int. Cl.[2] ..... B41J 15/22

[52] U.S. Cl. ..... 197/1 R; 101/93.04; 197/127 R; 197/133 R; 226/108

[58] Field of Search ..... 197/133 R, 1 R, 127, 197/128, 129, 138, 132, 134; 101/90; 226/108, 109, 110, 115

[56] References Cited

U.S. PATENT DOCUMENTS

| | | | |
|---|---|---|---|
| 1,418,506 | 6/1922 | Wood | 197/132 |
| 2,102,694 | 12/1937 | Garbell | 197/132 |
| 2,160,539 | 5/1932 | Clark | 197/132 |
| 2,201,407 | 5/1940 | Pfeiffer | 197/132 |
| 2,493,411 | 1/1950 | Canegan et al. | 197/133 R X |
| 3,114,500 | 12/1963 | Gavasso | 226/109 X |
| 3,444,977 | 5/1969 | Kinney et al. | 197/129 |
| 3,732,811 | 5/1973 | Oldenburg | 101/90 X |

FOREIGN PATENT DOCUMENTS

| | | | |
|---|---|---|---|
| 1,255,681 | 12/1971 | United Kingdom | 197/133 |

*Primary Examiner*—Edward M. Coven
*Attorney, Agent, or Firm*—J. T. Cavender; Wilbert Hawk, Jr.; George J. Muckenthaler

[57] ABSTRACT

A single clutch and associated actuator mechanisms in a drive line for providing selective driving or feeding of at least two printing media for independent bi-directional movement of the media in the operation of a plurality of printing functions. The drive or feed mechanism for the printing media occupies the space of a single printing station wherein drive members are arranged in an overlapping manner with individual control of such drive members.

4 Claims, 6 Drawing Figures

SINGLE STATION, PLURAL FUNCTION PRINTER

This is a continuation of application Ser. No. 638,796, filed Dec. 8, 1975, abandoned.

BACKGROUND OF THE INVENTION

In the area of high speed printing, prior apparatus and machines have included the provision for printing on a plurality of media at the several stations across a business machine. In one type of construction, there may be provided a single print head or like mechanism which travels across several printing stations or positions and with record media directed past each of such stations to accomplish printing on the desired media. In another type of construction, there may again be provided record media at several stations across the machine but with a plurality of print heads, each associated with its station for printing the desired information on the media. In a business machine, a normal or common type of construction may include a receipt station, a journal station, and/or a form or slip station wherein a receipt is printed and provided to the customer, a journal or audit is printed and retained in the machine, and a form or slip is utilized and which may be in the manner of a pass book or a document and have certain information printed thereon and then returned to the customer or deposited in a receptacle for further processing.

With the advent of more compact construction in business machines, it is desirable that the several functions or modes of such machines be contained within space and travel limitations for precise and high speed operation. Representative of a plurality of stations for accomplishing the printing on several media, as described hereinabove, is the data terminal shown and described in Cederberg Patent No. 3,825,681 which discloses dual print heads for operation at the receipt, audit, and form stations. Additionally, selective feeding of two superposed record media independently to a single printing station is disclosed in British Pat. No. 1,255,681.

SUMMARY OF THE INVENTION

The present invention relates to high speed printing and more particularly to paper or printing media feed mechanism wherein a plurality of functions are performed at a single printing station. The plurality of functions to be performed may include the providing of a printed receipt, the printing of a journal or audit trail, or the printing on a form or like document as in a business machine of compact design. A common drive line includes clutch and actuator means for providing drive to the receipt, journal, and slip rollers in independent manner wherein the rollers carry or move paper or like printing media past a common printing station. The feed roller or rollers are designed to be engageable with and disengageable from the paper at the desired times for driving the paper or form in a given transaction.

More specifically, the journal drive roller occupies a space at the printing station in the center thereof and the receipt drive rollers are positioned or displaced beyond the journal paper and its drive roller in overlapping manner and actuated at the desired times to drive the appropriate roller or rollers and the associated paper for the printing function. Certain of the slip rollers are in continuous drive engagement with the drive line and other drive rollers are actuated upon demand to accomplish a slip transaction. In this embodiment, the receipt paper is of wider width to be accommodated by the wider spaced drive rollers and in effect straddles the journal paper and its drive roller which carries the narrower journal paper past the single print station.

In view of the above discussion, the principal object of the present invention is to provide a compact printing mechanism in a business machine.

Another object of the present invention is to provide a single printing station for accommodating a plurality of printing transactions.

An additional object of the present invention is to provide paper drive mechanism occupying limited space for several printing functions and for moving the paper past a single printing station.

A further object of the present invention is to provide paper drive mechanism and actuators for moving the paper independently in a bi-directional path for the several printing functions.

Additional advantages and features of the present invention will become apparent and fully understood from a reading of the following description taken together with the annexed drawings, in which.

Figure 3:
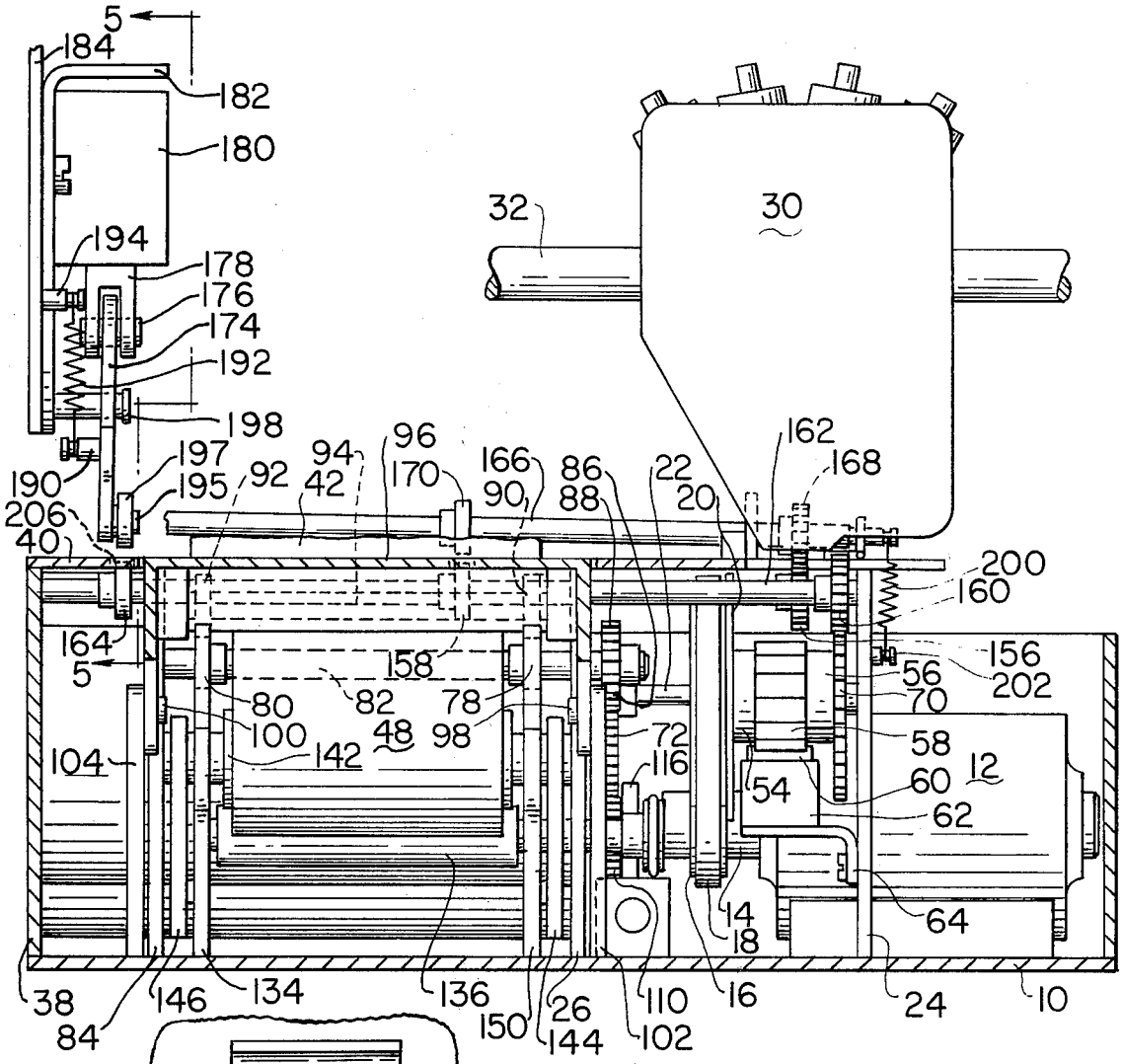
FIG. 3 is a front elevational view of the single printing station taken along the plane 3—3 of FIG. 2.
Figure 5:
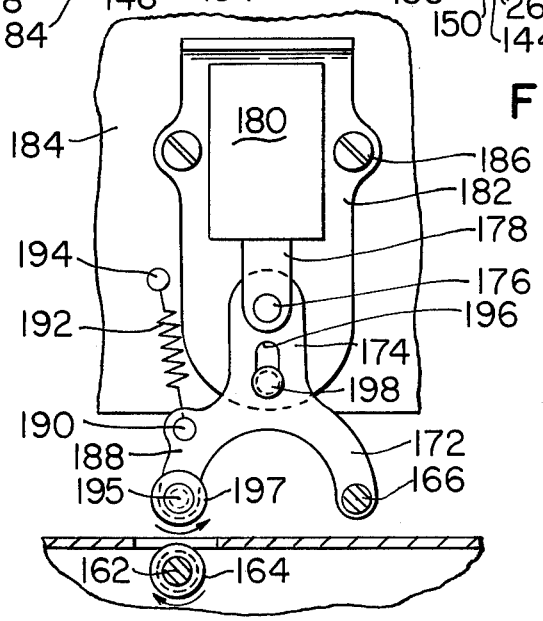
Figure 4:
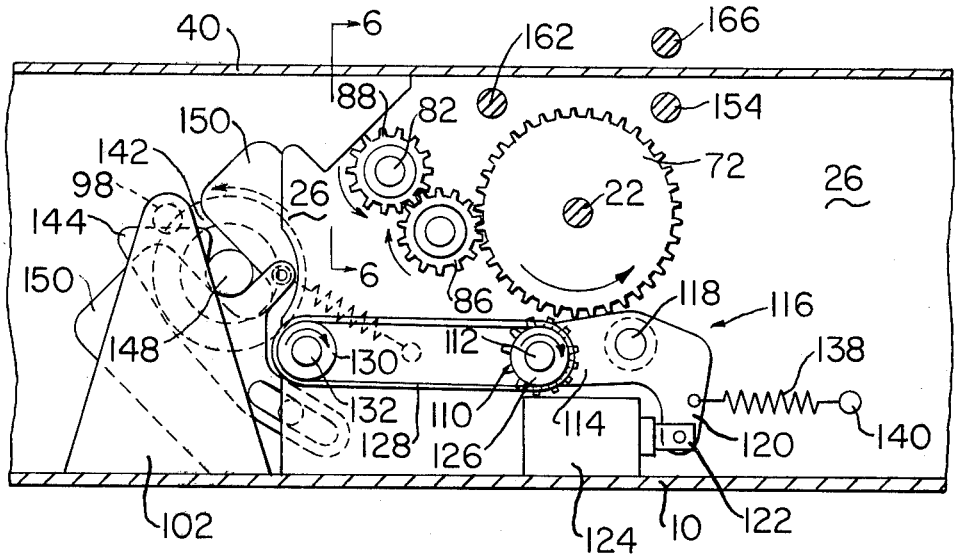
FIG. 4 is a right-hand side view of the drive line and certain actuating mechanism taken along the plane 4—4 of FIG. 1.
Figure 6:
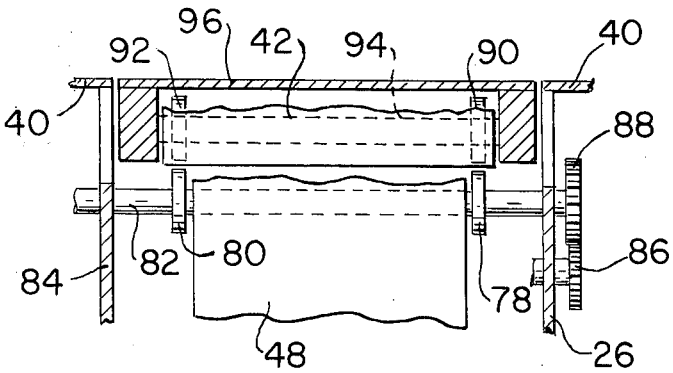

FIG. 5, on the sheet with FIG. 3, is a detailed view of operating mechanism for driving form type record media; and FIG. 6 is a view taken along the plane 6—6 of FIG. 4.

Figure 1:
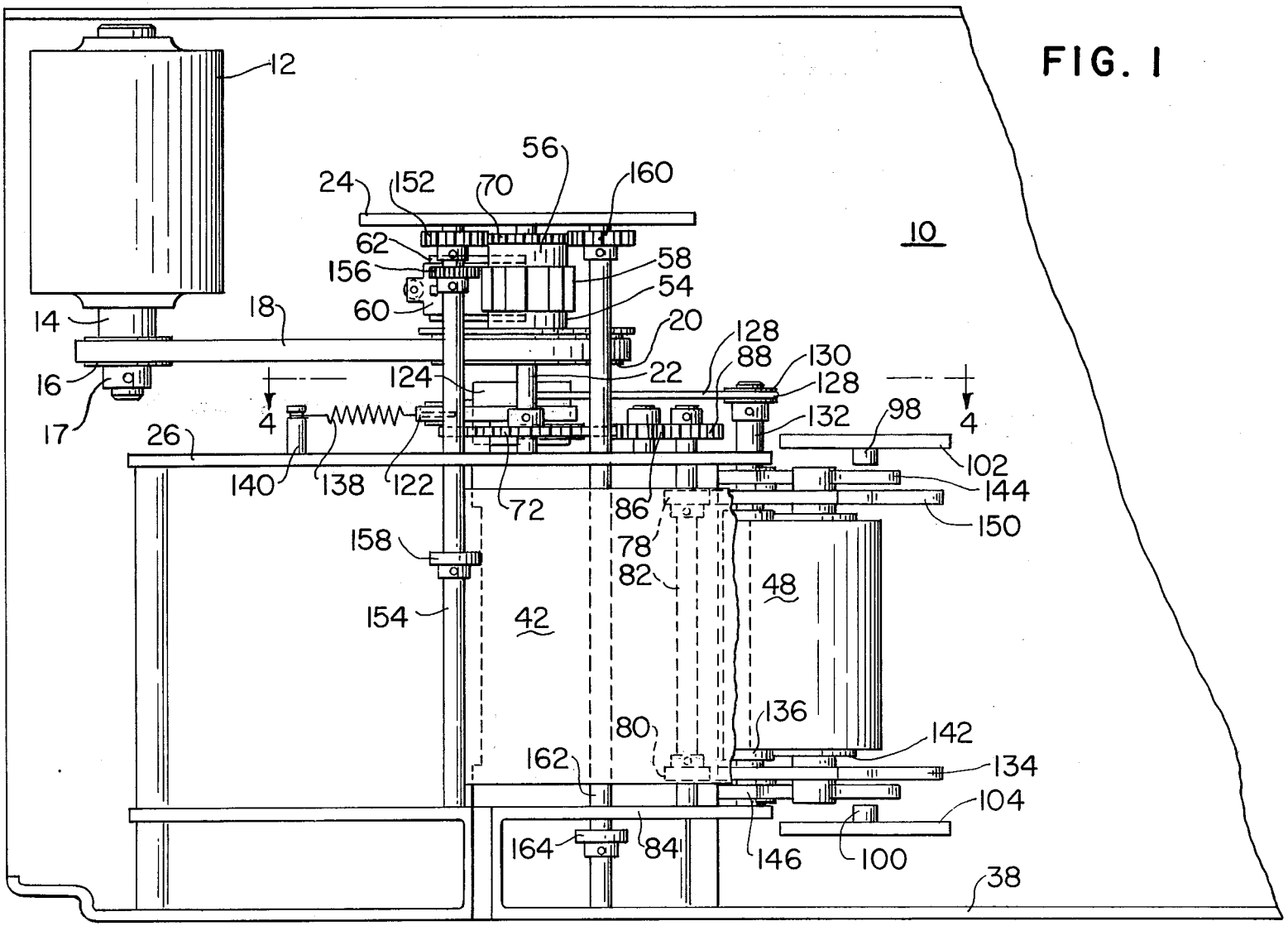
FIG. 1 is a plan view of a portion of a printer as seen from the left incorporating the subject matter of the present invention.
Figure 2:
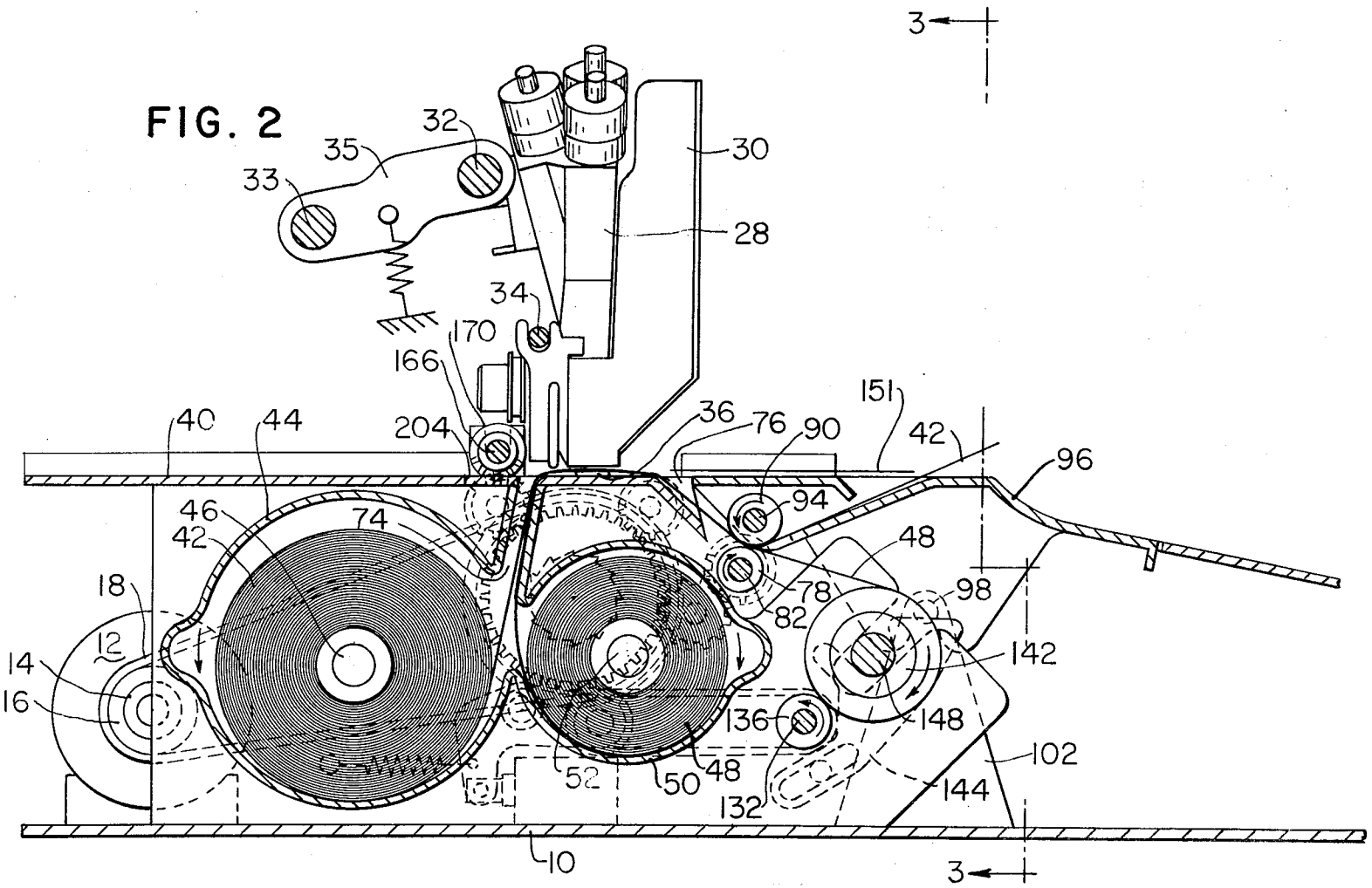
FIG. 2 is a left-hand side view showing the media supply rolls, certain of the drive rolls, and the paths of the respective printing media.

Referring now to FIGS. 1-3 of the drawings, there is shown a base 10 for supporting printing mechanism which receives motion from a motor 12 having a shaft 14 on which is mounted a drive pulley 16 containing a one-way bearing 17. The motor 12 may be of the bi-directional or reversing type, stepper motor or equivalent for driving the printing mechanism. A timing belt 18 is trained around the pulley 16 and around a pulley 20 secured to a main drive shaft 22 which has its right end journaled in an upright support plate 24 (FIGS. 1 and 3) secured to the base 10 and its left end journaled in a side frame plate 26, likewise secured to the base 10 and extending along the right hand side of the printing area of the printer (FIG. 3).

While FIG. 1 shows a plan view of a portion of a printer, having its front facing to the right, certain elements of the printer are not shown so as to clarify the area of the invention. For example, FIGS. 2 and 3 show a print head 28 and a ribbon cassette 30 attached to the front of the print head, the head 28 and cassette 30 being caused to travel in a side-to-side direction across the printing station by means of a shaft element 32 appropriately driven in a well-known manner. Driving of the print head 28 and the cassette 30 may be accomplished by means of the shaft element 32 wherein it is of the well-known lead screw type, or a cord or cable may be connected to the print head and through an arrangement of pulleys, the head and cassette are caused to be moved back and forth across the printing station. A spring-loaded bail 33 (FIG. 2) is connected to the element 32 by means of a connecting arm 35 to permit slight up and down movement of the print head 28 in cushioning manner as it is caused to be moved across the machine and the printing station. The print head 28 may be of the matrix type which includes the solenoid drivers operated to cause printing on record media as such media is driven past the printing station. Since the print head 28 and the cassette 30 assembly forms no part of the present invention, further description of same is not necessary other than to state that a lower guide rod 34, FIG. 2, is provided to maintain the print head along a precise path and attitude in relation to a platen 36 which comprises a flat, horizontally disposed member positioned across the machine at the printing station.

In addition to the base 10, the enclosure for certain lower parts of the machine include the right-hand side plate 26, a left-hand side plate 38, and a top plate or cover 40, which cover includes openings therein for passage of the record media in its path past the printing station, in addition to provisions for enabling certain related operations.

Since the present invention is directed to and covers a single station, plural or multiple-function printer, the structure includes mechanism and apparatus for printing a receipt of the transaction, a journal or audit of the transaction, and also for printing on a slip or form inserted at the single printing station. As seen in FIG. 2, a supply of receipt paper 42 is contained or stored in an enclosure or well 44 and supported on a roller 46 which is caused to be rotated in a counter clockwise direction for unwinding or unreeling of the paper to permit travel of the paper in a path past the printing station and toward the front of the machine or toward the right in FIG. 2. A supply of journal paper 48 is likewise contained or stored in an enclosure or well 50 and supported on a roller 52 which is caused to be rotated in a clockwise direction for unwinding or unreeling of the paper to permit travel thereof in a path past the printing station and toward the front of the machine, where the paper is rewound on a journal take-up roll to be maintained in the machine for audit purposes. The third function, that of printing on a slip or form, is effected when such slip or form is inserted into position on the upper plane of the top plate 40 and then caused to be moved rearwardly or to the left in FIG. 2 for a printing operation on the slip or form by the print head 28. Separate drive means for each of the several record media are included in the printer whereby a selection of the printing function is made possible.

Referring back to FIGS. 1 and 3, and as mentioned hereinabove, the main drive shaft 22 extends from the support plate 24 to the side frame plate 26 and is journaled in said plates, the shaft 22 having assembled and secured thereon at the right side of pulley 20 and adjacent thereto, a single, twelve position, incremental type spring clutch unit and actuator therefor, the clutch unit including a shaft input portion 54 - output hub portion 56 arrangement under the control of a spring (not shown) and a cam 58 positioned to be engaged by a pawl 60 actuated from a solenoid 62 supported on a bracket 64 secured to the side plate 24. While it should be mentioned that while the motor 12 may be of the reversing or bi-directional type to provide for back-and-forth or side-to-side travel of the print head and cassette assembly, the operation of the solenoid 62 is directed to the requirement for selecting one or more drive elements for driving the receipt paper 42, the journal paper 48, or for a slip or form inserted at the printing station. The solenoid 62 is operated for each line spacing of the printer to drive the various record materials, it being noted that the receipt paper 42 is advanced each and every time the printing operation calls for record material advancement.

Adjacent the spring clutch unit at the right side thereof, FIG. 1, is a first main drive gear 70 secured to the shaft 22 to be driven thereby in a direction of rotation dependent upon and corresponding to the direction of rotation of the motor 12. A second main drive gear 72 (see also FIG. 4) is secured to the shaft 22 at the left hand side thereof adjacent the side frame plate 26 for providing drive for the receipt paper 42 which travels in a path from the supply roll through a passageway 74, (FIG. 2) past the printing station, through a second passageway 76, and past receipt paper drive rolls 78 and 80 secured to a shaft 82 (see also FIG. 6) journaled in the right side frame plate 26 and in a left side frame plate 84. The second main drive gear 72 is engaged with and drives a spur gear 86 positioned on the right side of the frame plate 26 and secured to a stub shaft journaled therein, such spur gear 86 being engaged with a driving a gear 88 also positioned on the right side of frame plate 26 and secured to the shaft 82 for driving thereof along with the rollers 78 and 80. As seen in FIG. 2, the receipt paper 42 is caused to be positioned above the journal paper 48 when and after passing the printing station, and as illustrated in FIGS. 1, 3, and 6, the receipt paper 42 is wider than the journal paper 48 which occupies the space between the receipt paper drive rolls 78 and 80. Cooperating with such drive rolls 78 and 80 are pressure rollers 90 and 92 secured to a shaft 94 journaled in side walls of a movable cover portion 96 which portion is swingable on and removable from a pair of studs 98 and 100 secured to upright supports 102 and 104, (FIG. 3) in turn, secured to the base 10 of the machine.

Looking now to the drive means for the journal paper 48 which originates or is initiated from the main drive gear 72, FIG. 4, a spur gear 110 is positioned below the gear 72 adjacent the side frame plate 26 and secured on a shaft 112, the shaft 112 extending toward the right from the plate 26 (FIG. 3) for reception of one end 114 of a crank arm 116, the end 114 being journaled on the shaft 112 and the arm 116 being pivoted on a pin 118 journaled in the side plate 26, the other end 120 of the arm 116 being connected with the plunger 122 of a solenoid 124 secured to the base 10 of the machine adjacent the side plate 26. A drive pulley 126 is secured on the right end of the shaft 112 and a belt 128 is trained around the pulley 126 and extends forwardly to and around a pulley 130 secured to the right end of a shaft 132 extending leftwardly (FIG. 3) through the side plate 26 and across the journal paper width to an upright support plate 134, the shaft 132 being journaled in the plate 26 and in the plate 134. Shaft 132 has a friction drive roller 136 thereon for engaging with and driving the journal paper 48 upon demand when the solenoid 124 is actuated against the pull of a spring 138 connected to the arm 116 and to a stud 140 secured to the side plate 26.

A journal take-up roll 142 is supported from a pair of plates 144 and 146 by means of a shaft 148 (FIGS. 2 and 4) seated in slots in the plates, the shaft 148 also being movable on either side of the take-up roll 142 in angularly disposed slots in a support plate 150 at the right side of the roll 142 and in the left side support plate 134. The take-up roll 142 is spring loaded in the direction of the drive roller 136 from the take-up roll 142 to cooperate therewith and to provide proper tension on the journal paper 48 as it is being rewound on the take-up roll 142, such roll being swingable away from the drive roller 136 as the diameter of the take-up roll increases by reason of additional journal paper being wound and stored thereon. It is thus seen that as it is desired to increment the journal paper past the printing station, the solenoid 124 is actuated to draw the plunger 122 forward and thereby rock the arm 116 in a clockwise direction, FIG. 4, and swing the spur gear 110 into engagement with the drive gear 72 thereby driving the belt 128 to rotate the journal drive roller 136 for driving the journal paper 48.

The next portion of the description covers the structure for driving a slip or form 151 (FIG. 2) into position for printing thereon, the drive originating from the drive gear 70 on the right hand side of the clutch assembly and includes a gear 152 (FIG. 1) secured to a shaft 154 journaled at the right hand side thereof in the right side plate 24, and engaging with the gear 70, such shaft extending leftwardly through the plate 26 and across the machine and journaled in the side plate 84, there being a drive gear 156 adjacent the gear 152 and a drive roller 158 secured to the shaft 154 and positioned at approximately the center of the print station for purposes to be described. A gear 160 (FIGS. 1 and 3) forward of gear 152 is secured to a shaft 162 journaled in the side plate 24 and also engaging with the gear 70, the shaft 162 also extending leftwardly through the plate 26 and across the machine and journaled in the side plate 84 and in the frame plate 38, there being a drive roller 164 secured to the shaft 162 at a position between the side plate 26 and the frame plate 38 for a purpose to be described. A shaft 166 (FIGS. 2 and 3) is disposed above the slip or form printing surface, that is, above the cover or top plate 40, such shaft having a gear 168 engaging with gear 156, the shaft 166 extending across the machine, and there being an idler or pressure roller 170 positioned in relation to drive roller 158 to be engageable therewith. At the left hand side of the machine, the shaft 166 is journaled in one leg 172 of a yoke 174 (see FIG. 5) which yoke is connected by means of a pin 176 to the plunger 178 of a solenoid 180 secured to a bracket 182, in turn, secured to a side frame plate 184 by suitable screws 186. The other leg 188 of the yoke 174 has a stud 190 secured thereto, to which is connected one end of a spring 192 and having the other end connected to a stud 194 secured to the side frame plate 184. The leg 188 of yoke 174 also has a stud 195 on which is journaled an idler or pressure roller 197 positioned to be engageable with the driver roller 164. The yoke 174 has an elongated hole or slot 196 therein for reception of a pin 198 which is attached to the bracket 182, the yoke 174 being movable in an up-and-down direction upon operation of the solenoid 180, against the action of the spring 192, with the yoke being guided in such direction by the pin-and-slot connection.

The left end of the shaft 166 is made to be movable in the up-and-down direction by reason of the solenoid 180 – yoke 174 connection with the shaft, such shaft being swingably connected at the right hand end thereof, (FIG. 3), with the right hand end being supported and journaled in a slot-type bearing and being biased in a downward direction by a spring 200 connected to the end of the shaft and to a stud 202 secured to the side frame plate 24. The shaft 166 is continuously driven by engagement of the gear 156 with the gear 168, it being seen from FIG. 3 that a clearance exists between the lower drive roller 158 and the upper driven roller 170, near the center of the shaft 166, and also between the drive roller 164 and the driven roller 197 at the left side of the machine (see also FIG. 5). A cutout or slot 204 (FIG. 2) is formed in the top plate 40 for enabling the downward movement of the ider roller 170 therethrough for engagement of the idler roller 170 with the drive roller 158. Likewise, a slot 206 (FIG. 3) is formed in the plate 40 near the left hand side of the machine for enabling downward movement of the driven roller 197 therethrough for engagement of such roller 197 with the drive roller 164. The engagement of the several rollers, upon actuation of the solenoid 180 to swingably move the left end of the shaft 166 downwardly, provides the means for driving or advancing a slip or form to the proper position for printing thereon.

In the operation of the single station, multiple function printer, wherein the capacity of the printer is sixty columns wide, with such width being made available for certain slip or form applications, the thirty-three columns at the left hand side of the printer are used for the receipt and journal functions as well as certain other slip or form functions. All transactions on the printer have independent paper drive or advancing mechanisms with the exception of the receipt, which is advanced or driven with each and every line spacing of the machine. As mentioned above, the solenoid 62 is actuated to cause incremental rotation of the drive line which operation advances the receipt paper each time the clutch assembly is actuated to provide for line spacing. In this manner, the drive means for receipt paper advancement is caused to be energized and de-energized in response to each line of required print spacing. It is, therefore, seen that options include advancement of the receipt paper itself, advancement of the receipt paper and the journal paper, advancement of the receipt paper and the form or slip, and advancement of the receipt paper along with the journal paper and the slip or form, although the latter is not common practice. The receipt paper 42 and the slip or form 151 utilize an ink ribbon for printing while the journal paper 48 is of the self-contained or carbonless type enabling all printing performed on the receipt paper 42 to appear on the journal paper 48. With such through printing or robbing of the receipt, it is possible to print on multiple-part slips or forms 151 and also on the journal paper 48 during the same transaction.

The drive for the receipt paper 42 is accomplished from the main drive shaft 22 which drives the main gear 72 thereon, in turn driving the intermediate gear 86 and the drive gear 88 which rotates the shaft 82 and the receipt paper drive rollers 78 and 80 against which the receipt paper is pressed by the idler rollers 90 and 92 journaled on the removable cover portion 96, the drive rollers 78 and 80, and the idler rollers 90 and 92 being spaced apart and on either side of the journal paper 48 so as to specifically drive the receipt paper 42 and not to interfere with the path or flow of the journal paper 48.

When it is desired to drive or advance the journal paper 48, the solenoid 124 is energized which causes the gear 110 to engage with the main drive gear 72 and thereby drive the belt 128, in turn driving the journal drive roller 136 against the bias of the take-up roller 142 for storing the journal paper thereon.

The slip or form 151 is not carried by or within the machine but is placed into position on the top cover 40 adjacent and in front of the idler roller 197 to be captured thereby upon energizing the solenoid 180 to cause the roller 197 to be engageable with the drive roller 164 and to cause the idler roller 170 to be engageable with the drive roller 158 to drive the slip or form 151 into position for printing. As seen in the various views on the drawing, and as mentioned hereinabove, the roller 46 for the receipt paper 42 is caused to be rotated in a counter clockwise direction and the roller 52 for the journal paper 48 is caused to be rotated in a clockwise direction, as seen in FIG. 2, to advance the receipt paper and the journal paper past the printing station and toward the front of the printer, that is, toward the right in FIG. 2. When it is desired to print on a form or slip 151, such slip is inserted at the front of the machine and positioned to be engaged by the drive roller 158 - idler roller 170 and by the drive roller 164 - idler roller 197 combination if such slip is sufficiently wide for engagement by the spacing of the rollers, as seen in FIG. 3, or in the case of a narrow slip, either the roller 158 — roller 170 or the roller 164 — roller 197 may be used to advance the slip rearward or to the left in FIG. 2 to position the slip for a printing operation. It it thus seen from the gear arrangement in FIGS. 1, 2, 3, and 4 that rotation of drive shaft 22 and gear 70 meshing with and driving the gears 152 and 160 causes the shafts 154 and 162 to be rotated clockwise (FIG. 4) and in turn the drive roller 158 and the drive roller 164 are caused to be rotated clockwise to advance the slip 151 rearward (to the left in FIGS. 1 and 2, and to the right in FIG. 5). Drive for such slip 151 is, of course, actuated by energizing the solenoid 180 which causes the left end of shaft 166 (FIG. 3) to be moved downwardly wherein the idler rollers 170 and 197 press the slip against the drive rollers 158 and 164 for advancement of the slip.

Further in the operation of the printing mechanism and record media drive for the several functions or types of transactions, it is preferred that printing on the receipt paper 42 is accomplished with each and every printing operation, and if it is desired to retain a record or audit of the successive operations, the journal paper 48 drive mechanism is actuated so as to increment the paper into position. Of course, if it is desired not to retain a record or audit of each transaction in the machine, the journal paper 48 is not advanced and overprinting is performed on the paper. In the case of a slip or form 151, the receipt is printed through or robbed to effect printing on the slip or form. Suffice it to say that a variation of the receipt drive and control could enable overprinting on the receipt with printing on the journal paper 48 and on a form or slip 151. While it is not customary to provide for advancement of the several media at the same time, the receipt paper 42 is driven with each operation of the machine, by means of the drive rollers 78 and 80 engaging with the edge portions of the paper 42 and having cooperation with the pressure rollers 90 and 92, so as not to interfere with the journal paper 48. Printing on the journal 48 and the slip 151 or on the receipt 42 and the journal 48 are common operations attained with the present invention with means for selection of the drive or advancement of the desired record media. As mentioned above, the receipt paper 42 is driven or advanced with each and every operation of the machine, whereas the journal paper 48 and the slip paper 151 are selectively driven or advanced, as desired. Printing is usually performed on the receipt paper and on the journal paper, or on the journal paper and on the slip paper. Additionally, the receipt and the journal are printed in an ascending order, whereas the slip is printed in descending order, the ascending order being read from bottom to top and the descending order being read from top to bottom. In further clarifying the printing format and the reading thereof, the receipt paper 42 and the journal paper 48 are caused to be advanced toward the front of the machine or to the right in FIG. 2 with the printing occurring and being seen on the top surface of the record material. After completing the first line of printing on the receipt 42, such receipt is advanced forward or to the right and the next line of printing is performed in a line above the first line. Successive lines of printing appear on the receipt with the total amount appearing at the top, so that the receipt is printed in ascending order and the successive lines of printing are read from bottom to top to arrive at the total amount. In like manner, the journal is printed in ascending order with reading thereof from bottom to top. The slip 151, however, is caused to be advanced toward the rear of the machine or to the left in FIG. 2 with the first line of printing occurring at the top of the slip, the next line occurring below the first line, and successive lines printed in descending order with reading of the printing on the slip being from top to bottom. In repetition then, the receipt paper 42 is caused to be advanced after each and every line of printing, whereas the journal paper 48 and the slip 151 are caused to be selectively advanced by actuating the solenoid 124, in the case of the journal paper, and by actuating the solenoid 180, for the slip.

It is thus seen that herein shown and described is a single station, plural function printer which enables the use of a single print head to travel across the single station for one or more printing transactions, and wherein the paper advance or drive mechanisms are designed, structured and positioned to accommodate one or more of the printing media. Such printer enables the accomplishment of the objects and advantages mentioned above, and while only one embodiment of the invention has been disclosed herein, certain variations may occur to those skilled in the art. It is contemplated that all such variations, not departing from the spirit and scope of the invention thereof, are to be construed in accordance with the following claims.

What is claimed is:

1. Mechanism for driving a plurality of record materials across a stationary platen and past a single printing station for printing on different combinations of record materials, comprising drive means, driven means including a clutch assembly connected with said drive means for intermittent operation, first drive roller means including a first shaft and connected with said clutch assembly and operable to advance first record material past said printing station in one direction, second drive roller means including a second shaft parallel with said first shaft and connectable with said driven means and operable to advance second record material past said printing station in said one direction, the first record material being wider than the second record material and the first drive roller means having rollers spaced wider than the width of the second record material for driving the first record material independent from the second record material, electromagnetic actuating means for selectively connecting said second drive roller means with said driven means for driving said second drive roller means with said first drive roller means to advance the respective first and second record materials in said one direction, third drive roller means operable to advance third record material past said printing station in a direction opposite said one direction, said third drive roller means including a third shaft having one end thereof connected with said driven means, and electromagnetic actuating means for swingably moving the other end of said third shaft from an inclined attitude to a position parallel with and spaced from said first shaft to engage said third drive roller means with said third record material.

2. In a printer having a matrix print head movable across a printing station for printing on a plurality of record materials representing different types of records, means for advancing the record materials in selective manner to enble printing on different combinations thereof, comprising drive means, driven means connected with said drive means for intermittent operation, first drive roller means including a first shaft and connected with said driven means for advancing first record material past the printing station in one direction, second drive roller means including a second shaft parallel with and spaced from said first shaft and connectable with said driven means for advancing second record material past the printing station in said one direction, the first record material being wider than the second record material and the first drive roller means having rollers spaced wider than the width of the second record material for driving the first record material independent from the second record material, third drive roller means connectable with said driven means for advancing third record material past the printing station in a direction opposite said one direction, electromagnetic actuating means for connecting the second drive roller means with said driven means to advance the second record material along with the first record material, and electromagnetic actuating means for connecting the third drive roller means with said driven means to advance the first and the third record material, said third drive roller means including a third shaft having a gear member on one end thereof normally engaged with said driven means for rotation therewith and a drive roller on the other end thereof, said third shaft being moved from an inclined position to a straight position parallel with and spaced from said first shaft, whereby said drive roller is swingable into engagement with said third record material for advancing thereof upon actuating said third drive roller actuating means.

3. In the printer of claim 2 wherein said driven means includes gear means and said second drive roller means includes a member swingable into engagement with said gear means for advancing said second record material along with said first record material upon actuating said second drive roller actuating means.

4. In the printer of claim 3 wherein said third drive roller means includes a yoke member and said third drive roller actuating means is a solenoid for moving said yoke member for engaging said drive roller of said third roller means with said third record material for advancing said third record material.

* * * * *